United States Patent [19]

Schmidt, Jr. et al.

[11] 4,023,264

[45] May 17, 1977

[54] METHOD OF MAKING MINIATURE PLUG-IN FUSES OF DIFFERENT FUSE RATINGS

[75] Inventors: John Schmidt, Jr.; Avinash Aryamane, both of Mount Prospect, Ill.

[73] Assignee: Littelfuse, Inc., Des Plaines, Ill.

[22] Filed: June 21, 1976

[21] Appl. No.: 698,079

[52] U.S. Cl. ..... 29/623; 29/417; 113/116 P; 113/119; 337/198; 337/264; 337/295

[51] Int. Cl.[2] ..... H01H 69/02

[58] Field of Search ..... 29/610 R, 623, DIG. 15, 29/414, 417; 113/119, 116 P, 116 Y; 339/62, 147 P, 208; 337/198, 187, 201, 206, 255, 262, 263, 264, 293–295, 297

[56] References Cited

UNITED STATES PATENTS

| | | | |
|---|---|---|---|
| 1,777,916 | 10/1930 | Glössl | 29/623 X |
| 1,926,445 | 9/1933 | Klopfenstein | 337/264 |
| 2,908,887 | 10/1959 | Broske | 113/119 |
| 3,436,711 | 4/1969 | Borzoni | 337/198 |
| 3,669,054 | 6/1972 | Desso et al. | 113/119 |
| 3,775,723 | 11/1973 | Mamrick et al. | 337/297 X |
| 3,775,724 | 11/1973 | Mamrick et al. | 337/297 X |

FOREIGN PATENTS OR APPLICATIONS

| | | | |
|---|---|---|---|
| 1,237,325 | 6/1960 | France | 29/623 |
| 456,749 | 7/1968 | Switzerland | 29/623 |

*Primary Examiner*—Victor A. DiPalma
*Attorney, Agent, or Firm*—Wallenstein, Spangenberg, Hattis & Strampel

[57] ABSTRACT

A method is disclosed for making a plug-in fuse assembly like that disclosed and claimed in U.S. Pat. No. 3,909,767, granted Sept. 30, 1975 for Miniature Plug-In Fuse and having different desired fuse ratings. The method comprises the steps of providing a blank of fuse metal which is initially provided throughout its length with a continuous central portion of reduced thickness having a fixed thickness dimension for making fuses of a variety of fuse ratings, and blanking the blank of fuse metal to contain a pair of laterally spaced coplanar terminal forming blade portions which are interconnected by a transverse web of reduced thickness having a fixed thickness dimension, coplanar current carrying extensions thereof and an interconnecting fuse-forming link portion of reduced thickness having a fixed thickness dimension located in a coplanar platelike body of a plug-in fuse element. The interconnecting fuse-forming link portion of fixed reduced thickness dimension, provided by the blanking of the blank of fuse metal, is arranged in a desired location and is provided with a desired configuration, including width and length dimensions, to provide the desired fuse rating. The method also includes inserting over said blanked blank a synthetic plastic housing by way of an opening at the inwardly facing side thereof with the current carrying extensions of the blank and the interconnecting fuse-forming link portion of fixed reduced thickness dimension within the housing and with the pair of terminal blade portions of the blank, which are interconnected by the transverse web of fixed reduced thickness dimension, extending outwardly from the housing element through the opening therein, securing said blank in the synthetic plastic housing, and blanking the exposed transverse web of fixed reduced thickness dimension interconnecting the terminal blade portions to complete the formation of the coplanar plate-like body having a pair of aterally spaced coplanar terminal portions and of the plug-in fuse assembly.

14 Claims, 16 Drawing Figures

FIG. 1
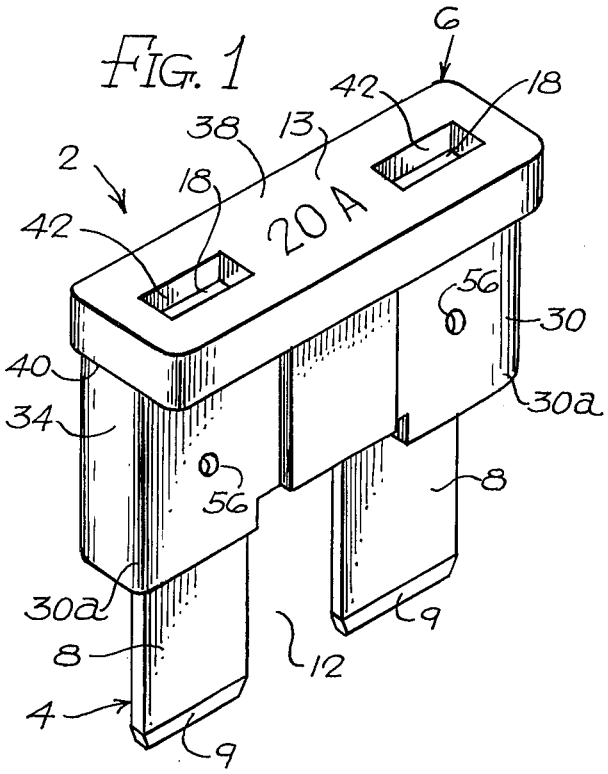
FIG. 2
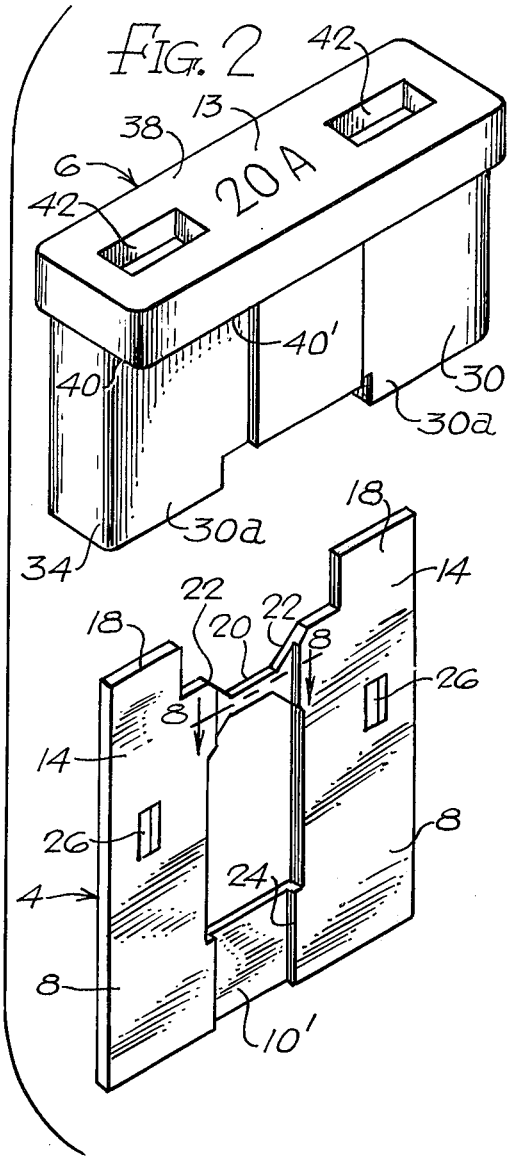
FIG. 3
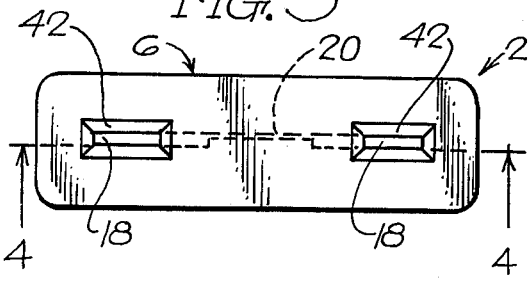
FIG. 4
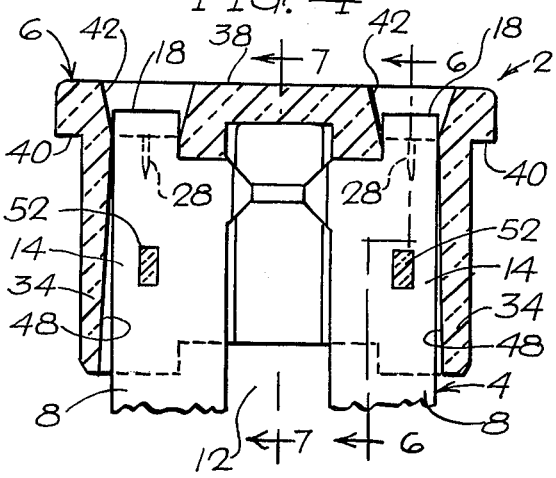
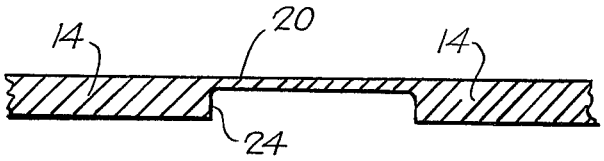
FIG. 8

FIG. 5
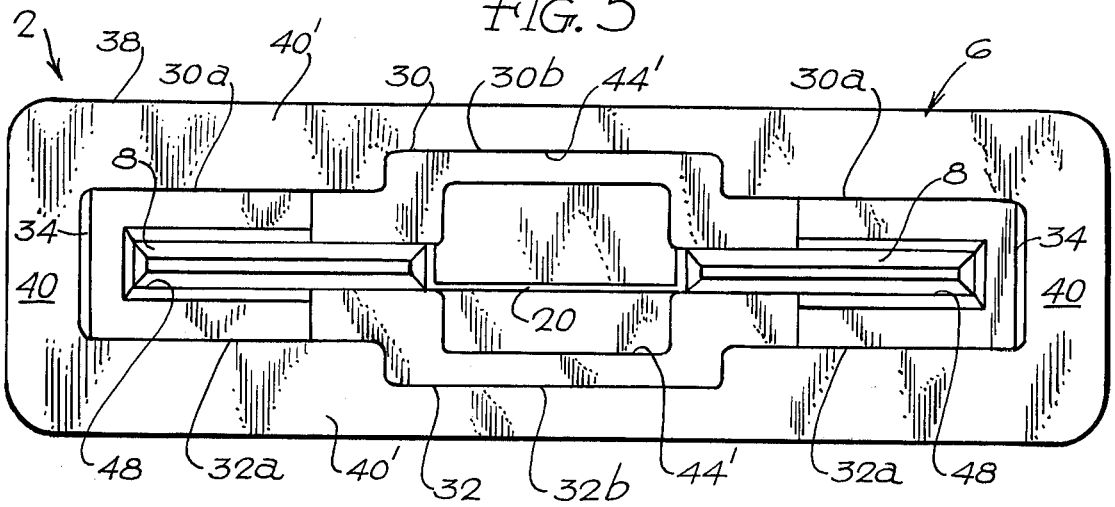
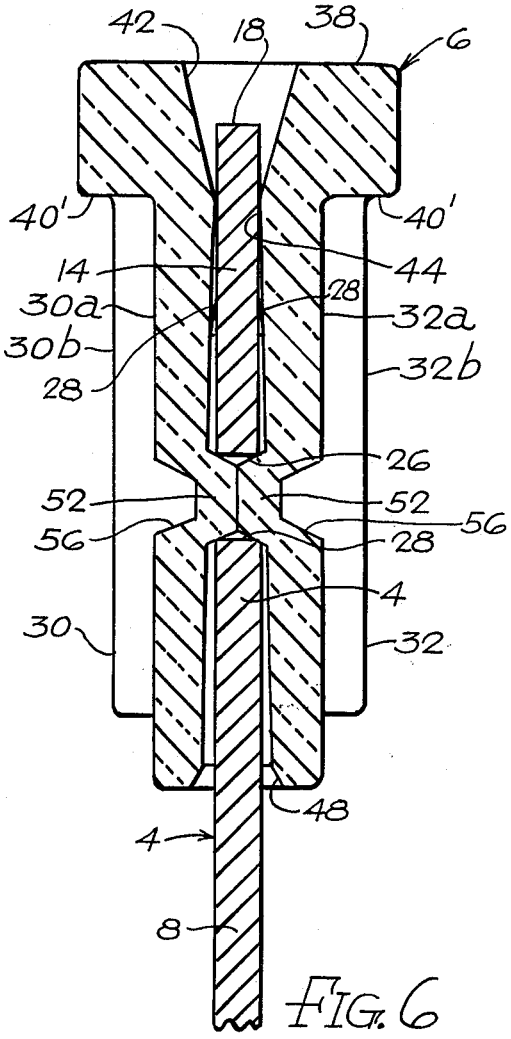
FIG. 6
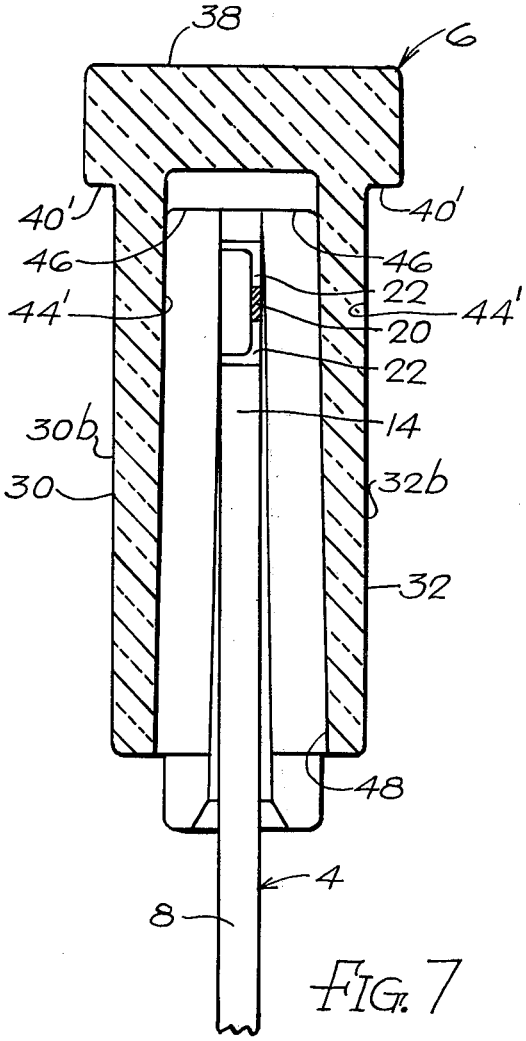
FIG. 7

DIMENSIONS COMMON TO ALL DESIGNS

DESIGN I
30 AND 25 AMPS.

DESIGN II
20 AND 15 AMPS.

DESIGN III
10 AMPS.

DESIGN IV
7½ AND 5 AMPS.

METHOD OF MAKING MINIATURE PLUG-IN FUSES OF DIFFERENT FUSE RATINGS

RELATED APPLICATIONS

This application is an improvement over co-pending applications Ser. No. 610,978, now U.S. Pat. No. 3,962,782 filed Sept. 8, 1975 for Method of Making a Miniature Plug-In Fuse and Ser. No. 640,253, now abandoned filed Dec. 12, 1975 for Method of Making a Miniature Plug-In Fuse.

The principal object of this invention is to provide an improved method for making a plug-in fuse assembly like the miniature plug-in fuse disclosed in U.S. Pat. No. 3,909,767, granted Sept. 30, 1975, and which constitutes an improvement over the method of making a miniature plug-in fuse disclosed in co-pending applications Ser. No. 610,978, filed Sept. 8, 1975 and Ser. No. 640,253, filed Dec. 12, 1975. More particularly, an object of this invention is to provide an improved method which eliminates the problems involved in the practice of the method of said co-pending applications Ser. Nos. 610,978 and 640,253.

BACKGROUND AND SUMMARY OF THE INVENTION

Briefly, this invention has to do with a method of making a plug-in fuse assembly like that disclosed in U.S. Pat. No. 3,909,767, granted Sept. 30, 1975, and which preferably comprises a plug-in element including a coplanar plate-like body of fuse metal having a pair of laterally spaced coplanar terminal forming blade portions to be received by pressure clip terminals in a mounting panel, coplanar current carrying extensions at the inner end portions of the pair of terminal forming blade portions and a fuse-forming link portion of reduced thickness interconnecting the current carrying extensions, and a synthetic plastic housing, which can be comprised of two confronting housing halves which can be assembled or snapped over the plug-in element, but which is preferably a one piece housing which is open at the inwardly facing side thereof, and which contains the coplanar plate-like body of the plug-in element with the current carrying extensions and the interconnecting fuse-forming link portion thereof of reduced thickness within the housing and with the pair of terminal forming blade portions thereof extending outwardly from the housing and preferably through the opening therein.

Generally, the method of making such a plug-in fuse assembly comprises providing a blank of fuse metal which is blanked or stamped to provide the pair of laterally spaced coplanar terminal forming blade portions which are interconnected by a transverse relatively rigid web, the coplanar current carrying extensions thereof and the relatively fragile interconnecting fuse-forming link portion of reduced thickness.

The synthetic plastic housing is inserted over said blank of fuse metal, preferably by way of the opening at the inwardly facing side of the one piece synthetic plastic member, with the current carrying extensions and the interconnecting fuse-forming link portion of reduced thickness of the blank preferably within the housing and with the pair of terminal blade portions of the blank, which are interconnected by the relatively rigid transverse web, extending outwardly from the housing element preferably through the opening therein. The blank of fuse metal is suitably secured in the synthetic plastic housing element as by staking or the like.

The exposed transverse web interconnecting the pair of terminal blade portions adds rigidity to the blank and securely maintains the relative positions of the pair of terminal blade portions, the current carrying extensions and the interconnecting fuse-forming link portion of reduced thickness, as the synthetic plastic housing is inserted over and secured to the blank. Thus, distortion, breakage or other damage to the blank is effectively prevented during these operations. The exposed transverse web of fuse metal interconnecting the exposed terminal blade portions of the blank is then blanked or stamped out to complete the formation of the coplanar plate-like body of fuse metal having the pair of laterally spaced coplanar terminal portions and of the plug-in fuse assembly. The housing is secured to the blank so that it acts as a rigid insulating interconnection between the current carrying extensions. Thus, the subsequent severance of the web does not adversely affect the strength of the resulting plug-in fuse element. Also, the outer end portions of the exposed pair of terminal forming blade portions may be coined to form tapers thereon to facilitate insertion thereof into the clip terminals in the mounting panel.

In the aforementioned U.S. Pat. No. 3,909,767 and in the method of the aforementioned co-pending application Ser. No. 610,978, the reduced thickness of the interconnecting fuse-forming link portion is provided by initially milling and squeezing the blank of fuse metal only at a point in the blank where the interconnecting fuse-forming link portion is formed by the subsequent blanking operation. This requires a separate milling and squeezing operation at a precise point in each blank of fuse metal. With this procedure it is extremely difficult to maintain sufficiently accurate tolerances for the reduced thickness of the fuse-forming link portion of the plug-in element, and this is compounded where the blanks form integral parts of a continuous intermittently advanced strip of fuse metal, wherein deviations in reduced thickness can also occur from blank to blank, all of which is detrimental to mass production of plug-in fuse assemblies having accurate fuse ratings. In addition to this problem of maintaining tolerances and accurate fuse ratings there is also the problem of time consumption and cost in such procedure.

In the method of the instant invention and of the aforementioned application Ser. No. 640,253, the aforesaid milling and squeezing operation at precise points in each blank and the aforementioned problems involved therewith are eliminated. Here, in the preferred form of the invention the blank of fuse metal is initially longitudinally provided throughout its length with a continuous central portion of reduced thickness so that, when the blank is blanked, the interconnecting fuse-forming link portion of the blank is of less thickness than the spaced coplanar terminal forming blade portions and the current carrying extensions. Preferably, a continuous strip of fuse metal is utilized which is initially longitudinally provided throughout its length with a continuous central portion of reduced thickness from which the coplanar plate-like bodies of the plug-in elements are to be formed. The continuous central portion of reduced thickness is preferably provided in the continuous strip of fuse metal by controlled conventional continuous milling and scarfing procedures, whereby the tolerances of the continuous central portion of reduced thickness throughout the length of the strip of fuse metal are kept within close limits. As a result, the thicknesses of the fuse-forming link portions of reduced thickness of the coplanar plate-like bodies of the plug-in elements, subsequently blanked from the strip, are maintained within close tolerances, not only in each plug-in element, but, also, from plug-in element to plug-in element blanked from the continuous strip.

The central portion of reduced thickness of the continuous strip or blank of fuse metal may be formed by milling and scarfing. The strip or blank of fuse metal is preferably selectively plated, such as tin plated, along only those portions which form the pair of laterally spaced coplanar terminal forming blade portions and the current carrying extensions thereof to provide, without short circuiting of the fuse-forming link portions thereof, improved electrical contact of the coplanar terminal forming blade portions of the ultimate plug-in element with the pressure clip terminals in the mounting panel in which they are received. (Such selective plating of the strip of fuse metal before it is blanked is an invention of Allen Ciesmier.)

As the strip of fuse metal having the continuous central portion of reduced thickness is sequentially advanced, it is blanked to provide at spaced intervals in the strip longitudinally interconnected blanks, each containing the pair of laterally spaced coplanar terminal forming blade portions which are interconnected by the transverse web, the coplanar current carrying extensions thereof and the interconnecting fuse-forming link portion of reduced thickness involved in the coplanar plate-like body of the plug-in fuse element.

In this connection, the method includes severing the end blank from the sequentially advancing strip of fuse metal and longitudinally inserting over said end blank of the sequentially advancing strip the synthetic plastic housing with the current carrying extensions and the interconnecting fuse-forming link portion of reduced thickness of the end blank within the housing and with the pair of terminal blade portions of the end blank, which are interconnected by the transverse web of the strip, extending outwardly from the housing through the opening therein. The severed end blank of the strip forming an almost completed plug-in fuse element is secured in the housing so the housing forms a rigid support between the current-carrying extensions. As expressed above, the exposed transverse web interconnecting the pair of terminal blade portions temporarily adds rigidity to the blank before and during the placement of the housing over the severed end blank. Since the strip of fuse metal, and, hence, the blanks formed therefrom are provided throughout their lengths with a central portion of reduced thickness, the transverse webs, interconnecting the pairs of terminal blade portions, is also of reduced thickness like the fragile fuse-forming link portion. However, the exposed transverse web has such a considerable width compared to the width of the fuse-forming link portion that it is effective in preventing distortion, breakage or other damage to the blank as it is inserted in and secured to the housing.

In the aforementioned copending application Ser. No. 640,253 the thickness of the central portion of reduced thickness of the blank of fuse metal and, hence, the thickness of the interconnecting fuse-forming link portion of the plug-in element are selectively varied and controlled to provide plug-in fuse assemblies with a given desired wide range of fuse ratings. Thus, a wide range of fuse ratings is accomplished with blanks having widely different thicknesses in the central portions despite the use of a single location and configuration of similar width and/or length dimension of the interconnecting fuse-forming link portions of reduced thickness. Thus, a single blanking die configuration may be utilized for a number of different ratings of the plug-in fuse assemblies. However, this requires the making and stocking of a large inventory of many different fuse metal strips and blanks to be selectively used. In addition to being costly, it is difficult to maintain accurate dimension tolerances in such inventory of many different fuse metal strips and blanks. Furthermore, particularly in the plug-in fuse assemblies of low ampere ratings, the thickness of the fuse metal strips and blanks are quite small which make them fragile and pose problems in handling such strips and blanks and in blanking the blanks to provide the interconnecting fuse-forming link portions therein.

The aforementioned difficulties involved in the method of making the miniature plug-in fuses of the aforementioned copending application Ser. No. 640,253 are eliminated, or at least minimized, by the method of the instant invention, Here, the continuous central portions of reduced thickness of the strips or blanks of fuse metal from which the fuse-forming link portions of both very low and very high current rated plug-in fuse elements are blanked can have a fixed non-fragile thickness dimension. This is achieved by blanking the strips or blanks of fuse metal so that the fuse-forming link portion of fixed reduced thickness dimension have widely varying locations, and/or configurations thereof. Thus, relatively low fuse ratings are obtained by locating the fuse-forming link portions at locations where heat conduction is at a minimum and by giving the same a thin, deeply undulating shape. The highest rated fuse would have a wide straight fuse link located at a point where heat conduction is at a maximum. By so doing, making and stocking of a large inventory of many different fuse metal strips and blanks covering a large range of fuse ratings is eliminated and costs are substantially reduced. Maintenance of accurate dimension tolerances is facilitated by the identically dimensioned strips and blanks. The identically dimensioned strips or blanks are readily handled and may be readily blanked without distortion or damage since the thickness dimensions of the central portions of the reduced thickness of the fuse metal strips and blanks may be maintained at a reasonable thickness affording strength thereto. The interconnecting fuse-forming link portions remain strong and they are not fragile. While separate blanking dies are needed for each fuse rating, the costs thereof constitute initial tooling costs, as distinguished from ongoing material costs involved with the use of many different strips and blanks of fuse metal, so that the total costs for the manufacture of the plug-in fuse assemblies of this invention will be considerably less, particularly on a mass production basis, this in addition to better tolerance control and handling.

Further objects of this invention reside in the particular method steps and in the cooperative relationships between the method steps in making the aforementioned plug-in fuse assembly.

Other objects and advantages of this invention will become apparent to those skilled in the art upon reference to the accompanying specification, claims and drawings.

DESCRIPTION OF THE DRAWINGS

FIG. 1 is a perspective view of a preferred form of the plug-in fuse assembly of the invention;

FIG. 2 is an exploded view of the housing and plug-in fuse element for making up the plug-in fuse assembly of FIG. 1;

FIG. 3 is a top plan view of the plug-in fuse assembly of FIG. 1;

FIG. 4 is a vertical longitudinal sectional view through the plug-in fuse assembly shown in FIG. 3, taken along section line 4—4 therein.

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof;

FIG. 7 is an enlarged vertical transverse sectional view through the center portion of the plug-in fuse assembly shown in FIG. 4, taken along section line 7—7 thereof;

FIG. 8 is an enlarged fragmentary sectional view through the fuse link portion of the plug-in fuse assembly shown in FIG. 2, taken substantially along section line 8—8 of FIGS. 2 and 15 and 16, and showing the preferred manner in which the fuse-forming link portion thereof is reduced in thickness.

DESCRIPTION OF THE PREFERRED EMBODIMENT OF THE INVENTION

Referring now more particularly to FIGS. 1–4, there is shown a plug-in fuse assembly 2 made of only two component parts, namely a plug-in fuse element 4 which most advantageously in a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking and ultrasonic welding operation to be described.

The plug-in fuse element 4 has terminal-forming blade portions 8—8 extending in spaced parallel relationship from the inner or bottom margin of the housing 6 in what will be referred to as a downward or inwardly extending direction. The ends of the terminal-forming blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel apertures. The current rating of the plug-in fuse assembly is indicated by indicia 13 on the outer wall of the housing as shown in FIGS. 1–2.

Figure 15:
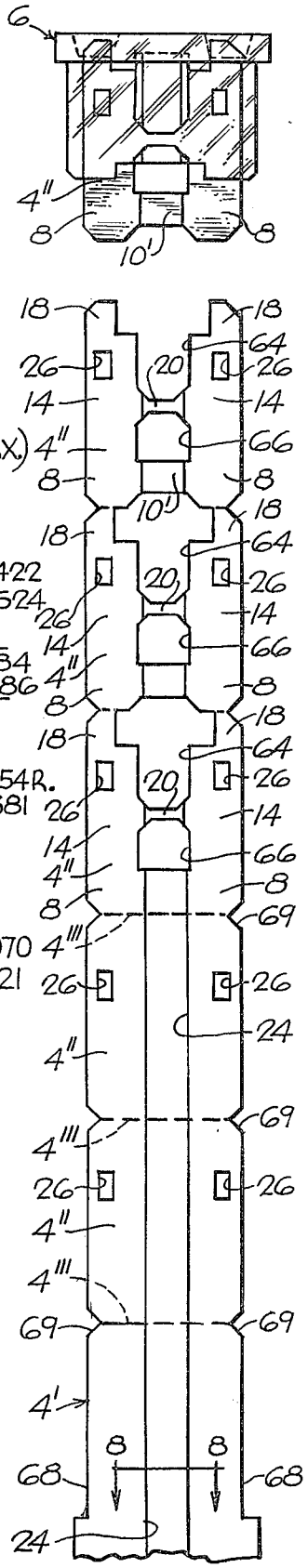
FIG. 15 is an elevational view diagrammatically illustrating a method of blanking the strip of fuse metal to provide a plug-in fuse element of design I and the application of the housing thereto to provide a plug-in fuse assembly having a fuse rating of 30 or 25 ampere.
Figure 16:
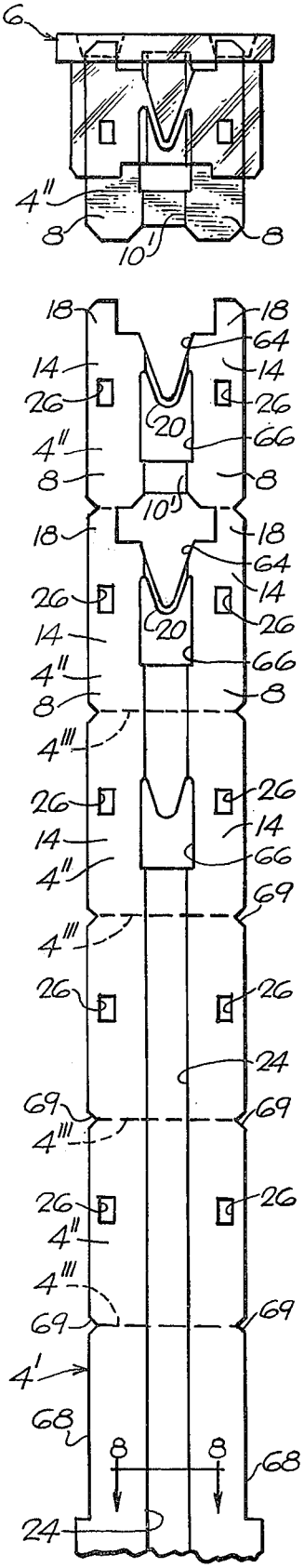
FIG. 16 is an elevational view diagrammatically illustrating a method of blanking the strip of fuse metal to provide a plug-in fuse element of design III and the application of the housing thereto to provide a plug-in fuse assembly having a fuse rating of 10 ampere.

The plug-in fuse element 4 is blanked or stamped from a strip 4′ of fuse metal (FIGS. 15 and 16). Prior to the plug-in fuse element being severed from the strip 4′, the terminal forming blade portions 8—8 are interconnected to form a transverse rigidifying web 10′ for the strip 4′, and so a central portion of material is stamped from the transverse web 10′ to form the terminal-forming blade portions 8—8 and a gap 12 between the same. The tapered portions 9—9 of the terminal-forming blade portions 8—8 may be formed by coining dies (not shown) preferably after the operation which severs the plug-in fuse element from the strip.

The terminal-forming blade portions 8-8 have current carrying extensions 14—14 projecting into the aforementioned space formed by the housing 6, which current-carrying extensions project well up into the upper or outer extremities of the housing 6, to be contiguous to the front or outer wall of the housing to be described. The outer end portions of the current-carrying extensions 14—14 are interconnected by a fuse-forming link portion 20 which is preferably both narrower in width and much smaller in thickness than the other current-carrying portions of the plug-in fuse element 4. The current-carrying capacity of the fuse-forming link portion 20 may be varied by varying its location and its configuration including its width and length dimensions. In the particular configurations of the plug-in fuse element 4 shown in FIGS. 2, 4, 11 and 12 of the drawings the current carrying extensions 14—14 join the fuse-forming link portion 20 of the plug-in fuse element 4 by tapered portions 22—22. All of the various parts of the plug-in fuse element are substantially in coplanar relation so no metal bending operations need be performed in the process of making the same.

The reduction of the thickness of the fuse metal of the fuse-forming link portion 20 is preferably achieved by initially providing the strip 4′ of fuse metal and, hence, the blanks 4″ of the strip with a centrally arranged groove 24 extending longitudinally throughout the strip 4′, as shown in FIGS. 8, 15 and 16, to provide a longitudinally extending central portion of reduced thickness in the strip 4′ and the blanks 4″ located at one face of the strip as in FIG. 8. The groove 24 is preferably formed in the strip 4′ by initially milling and scarfing the strip under close control of tolerances in conventional fashion to provide a central portion of reduced thickness in the strip of fuse petal which is maintained within close tolerances.

Different desired fuse ratings of the plug-in fuse assembly are determined by the composition of the fuse metal in the strip 4 of fuse metal, the thickness dimension of the fuseforming link portion 20, the location of the fuse forming link portion 20, and the configuration of the fuse forming link portion 20 including width and length dimensions. Here, the composition of the fuse metal and the thickness dimension of the fuse-forming link portion 20 are fixed parameters since the plug-in fuse elements having different fuse ratings are all fabricated from a common strip or blank of fuse metal having a continuous central portion of reduced thickness of fixed thickness dimension. The different desired fuse ratings are here obtained by selectively arranging the fuse-forming link portions 20 of fixed reduced thickness dimension in desired locations and by selectively providing the fuse-forming link portions 20 with desired configurations including width and length dimensions. Typical examples of plug-in fuse elements 4 to provide the plug-in fuse assemblies having a wide range of ampere fuse ratings (including ratings of 30, 25, 20, 15, 10, 7 ⅔ and 5 amperes) are illustrated in FIGS. 9 to 14 and described below, the various dimensions being in millimeters and the scale of the figures being approximately 4:1.

Figure 9:
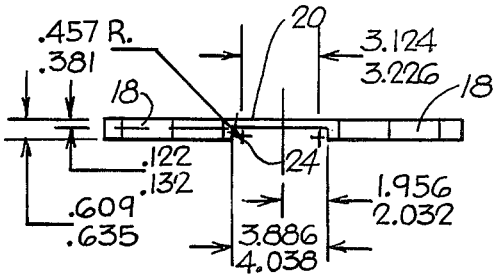
FIG. 9 is a top view of the plug-in fuse elements illustrated in FIGS. 2 and 11 to 14 setting forth typical dimensions which are common to the various different plug-in fuse elements having different fuse ratings.
Figure 10:
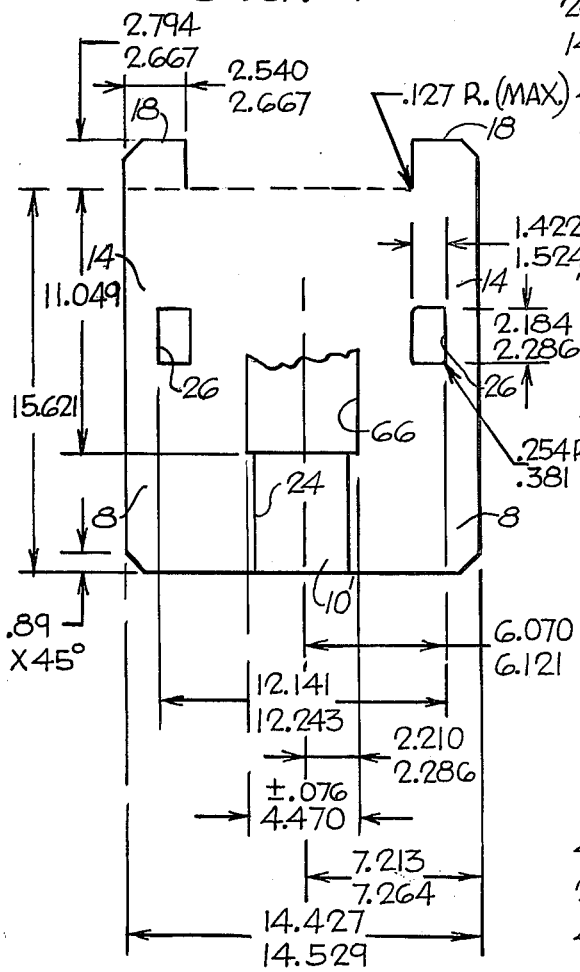
FIG. 10 is an elevational view of the plug-in fuse elements illustrated in FIGS. 2 and 11 to 14 setting forth typical dimensions which are common to the various different plug-in fuse elements having different fuse ratings.

The fuse metal strip 4' and the blanks 4'' formed therefrom may have the following composition in weight percent, Fe 0.08 max., Cd 0.07 max., Cu 0.75–1.25, Pb 0.10 max., Mg 0.01 max. and Zn balance. The strip of fuse metal as shown in FIG. 9 has a thickness of 0.609/0.635 and a continuous central portion of reduced thickness, formed by a groove 24 on one side of the strip, having a fixed thickness dimension of 0.122/0.132 and a groove width of 3.886/4.038. These are parameters which are fixed regardless of the desired fuse ratings for the plug-in fuse assemblies. There are also further fixed dimensions which are also present in the plug-in fuse elements regardless of the fuse ratings thereof, as set forth in FIG. 10 including the length and the width dimensions of the plug-in fuse element, the dimensions of the extensions 18, the dimensions of the apertures 26, and the width dimension and the length limiting dimension of the blanked portion 66 of the element.

Figure 11:
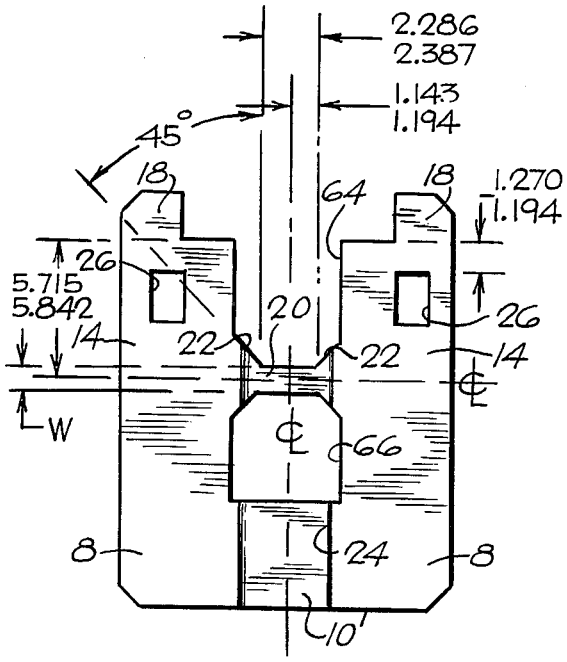
FIG. 11 is an elevational view of design I of the plug-in fuse element setting forth additional typical dimensions for providing 30 and 25 ampere fuse ratings for the plug-in fuse assembly.

FIG. 11 illustrates Design I of the plug-in fuse element for providing fuse ratings of 30 and 25 amperes. It sets forth dimensions for the locations of the openings 26 and of the fuse-forming link portion 20, it being noted that the centerline of the fuse-forming link portion 20 is located a substantial distance (5.713/5.842) from the upper edge of the coplanar current carrying extensions 14 while the openings 26 are located a relatively short distance (1.270/1,397) therefrom. The "blowing" of the fuse-forming link portion 20 is dependent upon the temperature thereof which in turn is dependent upon the current flowing therethrough which heats the same and upon the rate of dissipation of heat therefrom. In this Design I of FIG. 11, the fuse-forming link portion 20 is interconnected between the current extensions 14 near the terminal forming blade portions 8 so that heat may be readily dissipated from the fuse-forming link portion 20 to the terminal forming blade portions 8 and the pressure clip terminals (not shown) receiving such terminals. This heat dissipation effect is maximised by the large cross sectional area of the current carrying extensions leading to the terminal forming blade portions since such cross sectional area in such heat dissipation path is not decreased by the openings 26, the openings being outside of such heat dissipation path. As a result, Design I of FIG. 11 can conduct relatively high currents before "blowing" and provides a plug-in fuse assembly of relatively high ampere rating, such as 30 and 25 amperes.

In this design I of FIG. 11, the effective length of the fuse-forming link portion 20 is 2.286/2.387 and for a 30 ampere fuse rating the width dimension W is 1.143 ± 0.025, while for a 25 ampere fuse rating the width dimension W is 0.889/0.927. The smaller width dimension W for the 25 ampere fuse rating causes the fuse-forming link portion 20 to heat up to a greater temperature for a given current passing therethrough than for the larger width dimension W for the 30 ampere fuse rating with the result that the former will "blow" at 25 amperes and the latter will "blow" at 30 amperes.

Figure 12:
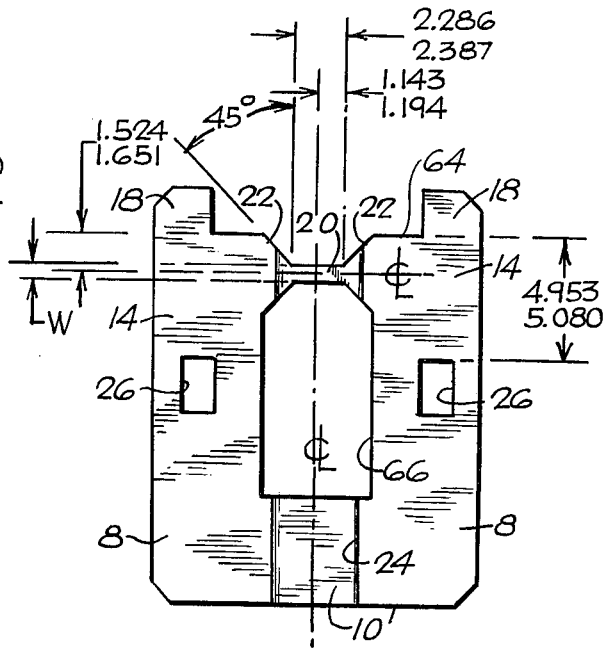
FIG. 12 is an elevational view of design II of the plug-in fuse element setting forth additional typical dimensions for providing 20 and 15 ampere fuse ratings for the plug-in fuse assembly.

FIG. 12 illustrates Design II of the plug-in fuse element for providing fuse ratings of 20 and 15 amperes. It sets forth dimensions for the locations of the openings 26 and of the fuse-forming link portions 20, it being noted that the centerline of the fuse-forming link portion 20 is located a relatively short distance (1.524/1.651) from the upper edge of the coplanar current carrying extensions 14 while the openings 26 are located a substantial distance (4.953/5.080) therefrom. Here, as in Design I and the other Designs of this invention, the blowing of the fuse forming link portion is dependent upon the temperature thereof which in turn is dependent upon the current flowing therethrough which heats the same and upon the rate of heat dissipation therefrom. In the Design II of FIG. 12, the fuse-forming link portion 20 is interconnected between the current carrying extensions 14 near the upper edges of the extensions 14 and remote from the terminal forming blade portions 8 so that heat is not dissipated away from the fuse-forming link portion to the terminal forming blade portions 8 and the pressure clip terminals (not shown) receiving such terminals as rapidly as in Design I of FIG. 11. This heat dissipation effect is also minimized by the decrease in cross sectional area in such heat dissipation path occassioned by the openings 26 in such path. As a result, Design II of FIG. 12 will not conduct as much current before "blowing" as in the case of Design I of FIG. 11 and therefore provides a plug-in fuse assembly having a lower fuse rating, such as 20 and 15 amperes.

In this Design II of FIG. 12, the effective length of the fuse-forming link portion 20 is 2.286/2.387, the same as in Design I of FIG. 11. For a 20 ampere fuse rating the width dimension W is 0.648/0.674 while for a 15 ampere fuse rating the width dimension W is 0.414/0.440. The smaller width dimension W for the 15 ampere fuse rating causes the fuse-forming link portion 20 to heat up to a greater temperature for a given current passing therethrough than for the larger width dimension W for the 20 ampere fuse rating with the result that the former will "blow" at 15 amperes and the latter will "blow" at 20 amperes.

Figure 13:
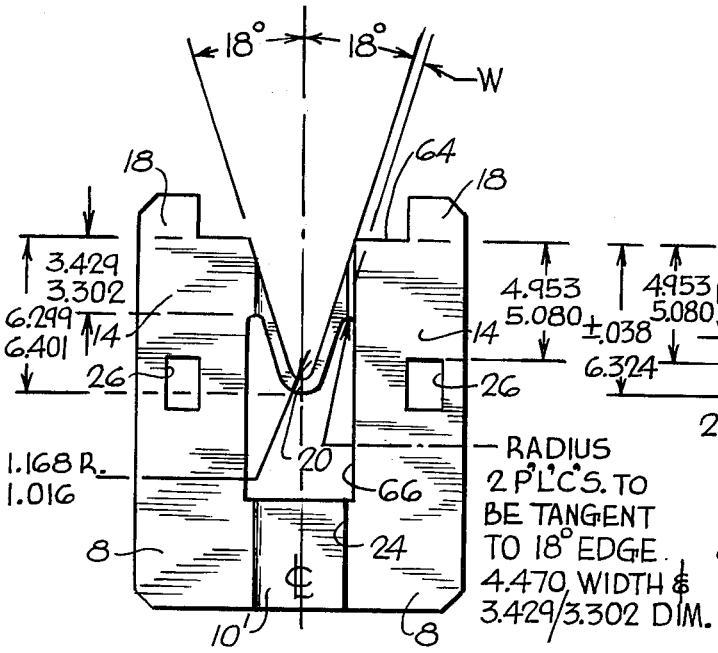
FIG. 13 is an elevational view of design III of the plug-in fuse element setting forth additional typical dimensions for providing 10 ampere fuse ratings for the plug-in fuse assembly.

FIG. 13 illustrates Design III of the plug-in fuse element for providing a fuse rating of 10 amperes. It sets forth dimensions for the locations of the openings 26 which are the same as for Design II and for the location and configuration of the fuse-forming link portion 20. The fuse-forming link portion 20 is located a short distance from the upper edge of the current carrying extensions 14 and remote from the terminal forming blade portions 8 and interconnects with the current carrying extensions above the openings 26, also, as in Design II, with similar heat dissipation characteristics. The fuse-forming link portion 20 has a substantially V-shaped configuration to provide a longer fuse-forming link portion than in Design II. In this connection, the bottom edge of the upper portions of the fuse-forming link portion 20 is located 3.429/3.302 from the upper edge of the current carrying extensions and the bottom edge of the central portion 6.299/6.401 therefrom.

The two legs of the V-shaped fuse-forming link portion 20 of Design III of FIG. 13 are each arranged at 18° from the vertical and merge in a radius of 1.168/1.016 and the width W of the fuse-forming link portion 20 is 0.521/0.559. Where the bottom edge of the fuse-forming link portion 20 interconnects with the current carrying extensions 14, it is provided with radii of 0.305/0.203 which are tangent to the 18° edge, the 4.470 width edges of the blanked portion 66 and the 3.429/3.302 dimension. The fuse-forming link portion 20 of FIG. 13 having this location and this configuration including the length and width dimensions provides the plug-in fuse assembly with a fuse rating of 10 amperes.

Figure 14:
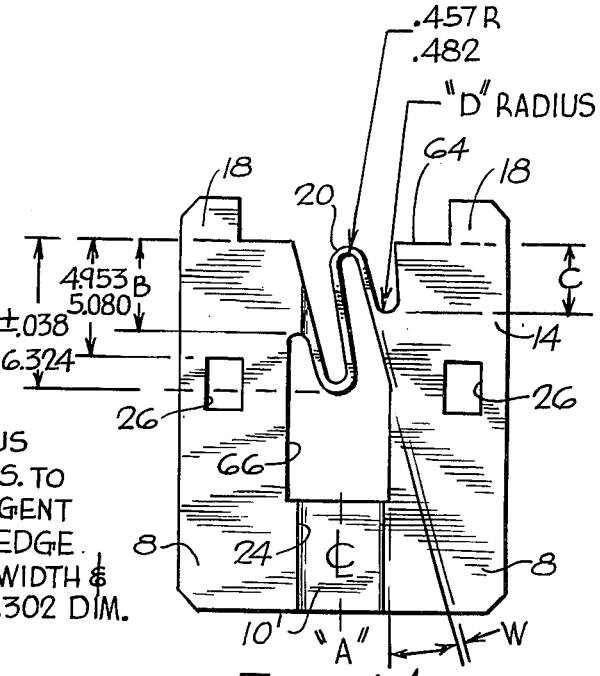
FIG. 14 is an elevational view of design IV of the plug-in fuse element setting forth additional typical dimensions for providing 7½ and 5 ampere fuse ratings for the plug-in fuse assembly.

FIG. 14 illustrates Design IV of the plug-in fuse element for providing fuse ratings of 7 ½ and 5 amperes. It sets forth dimensions for the locations of the openings 26 which are the same as for Designs II and III and for the locations and configurations of the fuse-forming link portion 20. Here, also, the fuse forming link portion 20 is located a short distance from the upper edge of the current carrying extensions 14 and remote from the terminal forming blade portions 8 and interconnects with the current carrying extensions above the openings 26, and has heat dissipation characteristics similar to those of Designs II and III. The fuse forming link portion 20 of FIG. 14 has a substantially S-shaped configuration to provide a still longer fuse-forming link portion than in Designs II and III. In this connection, the bottom edge of the fuse-forming link portion 20 is located 6.324 ± 0.038 from the upper edge of the current carrying extensions and the top edge thereof is located even with the upper edge of the extensions 14.

In Design IV of FIG. 14, the central portion of the substantially S-shaped fuse-forming link portion 20 is connected by radii of 0.457/0.482 to the end portions thereof and the end portions are also interconnected by radii D to the current carrying extensions 14 at distances B and C. The end portions of the fuse-forming link portion 20 are arranged at an angle A and the fuse-forming line portion 20 has a width W. For a 7 ½ ampere fuse rating, angle A is 13°, distance B is 4.124, distance C is 2.210, radius D is 0.406/0.432 and width W is 0.609/0.635. On the other hand, for a 5 ampere fuse rating, angle A is 15°30′, distance B is 3.362, distance C is 2.692, radius D is 0.457/0.482 and width W is 0.406/0.432. The fuse-forming link portion 20 for the 5 ampere fuse rating is longer and has less width than that of the 7 ½ ampere fuse rating.

The foregoing sets forth, by way of specific example, how different desired fuse ratings may be obtained with plug-in fuse elements having many common dimensions including fuse-forming link portions 20 of fixed thickness dimension by selectively arranging the fuse-forming link portions in desired locations and by selectively providing the fuse-forming link portions 20 with desired configurations including width and length dimensions.

While the plug-in fuse element 4 may be used as a fuse element without its incorporation in the housing 6, for safety reasons it is preferred to incorporate the plug-in fuse element 4 in the housing 6. To this end, and for reasons to be explained, the outer end portions of the terminal extensions 14—14 are provided with outwardly or upwardly projecting tabs 18—18 adapted to make contact with test probes to test for the continuity of the fuse-forming link portion 20 of the plug-in fuse element 4. Also, to anchor the plug-in fuse element 4 within the housing 6, anchoring apertures 26—26 are formed in the terminal extensions 14—14 to receive anchoring projections to be described formed in the housing walls.

While the housing 6 could be made in two separate parts snappable together, the housing is most advantageously a single piece molded part as previously indicated. Also, it preferably has a narrow elongated configuration formed by relatively closely spaced side walls generally indicated by reference numeral 30–32, the side walls having end portions 30*a*–32*a* and 30*a*–32*a* which are spaced together much more closely than the central or intermediate portions 30*b*–32*b* thereof. The side walls 30–32 are interconnected at their end margins by narrow end walls 34—34, and at their outer or top margins by an outer wall 38 which overhangs the rest of the housing to form downwardly facing shoulders 40—40 at the longitudinal ends of the outer wall 38 and downwardly facing shoulders 40′—40′ along the longitudinal side margins of the housing 6. The shoulders 40′—40′ are coplanar continuations of the shoulders 40—40 at the ends of the housing 6.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immediately beneath the access openings 42—42 are relatively small because of the close spacing of the side wall portions 30*a*–32*a* of the housing at these points, the width of the space portions 44—44 as viewed in FIG. 6 tapering from the bottom open end of the housing upwardly toward the terminal access openings 42—42, reaching a narrow dimension about equal to the thicknes of the plug-in fuse element 4. The space portions 44—44 are provided on opposite sides thereof with small inwardly directed ribs 28 for engaging and centering the upper portions of the plug-in fuse element 4 in the housing 6. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8 of the plug-in fuse element.

The fuse-forming link portion 20 of the fuse element 4 is positioned in a relatively wide portion 44′ (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44′ of the space within the housing 6 open onto the bottom of the housing for full extent thereof through an entry opening 48. The opening 48 permits the housing to be pushed over the end portion or end blank of the pre-stamped and milled strip 4′ from which a completed fuse element is punched and immediately following the housing 6 is secured to the end portion or end blank of the strip as previously indicated.

The housing 6 is preferably a molded part made of a transparent synthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing is preferably molded of a high temperature transparent Nylon made by Belding Chemical Industries of New York City, New York (Produce Code No. LX-3330).

While the housing interior 6 could be made with resilient projections which snap into the anchoring apertures or openings 26—26 in the plug-in fuse element 4, it is preferred to secure the housing in place by forming projections 52 from both sides of the housing 6 by a cold staking operation, which enter the anchoring apertures 26—26 of the plug-in fuse element 4. The inwardly extending projections 52 formed by the cold staking operation where they engage each other in the anchoring apertures or openings 26 are preferably welded together by ultrasonic welding or the like to provide a rigid anchoring structure. The depressions 56 left by the staking operation are shown in the side wall 30 in FIGS. 1 and 6.

The exemplary embodiments of the invention just described have thus provided an exceedingly reliable, compact and inexpensive to manufacture plug-in fuse assembly which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounted on the mounting panel. The terminal access openings enable test equipment to test the continuity of the fuse if the user does not desire to rely solely on a visual observation of the fuse-forming link portion of the fuse.

The preferred method of making the plug-in fuse assembly is illustrated in FIGS. 15 and 16, FIG. 15, for example, having to do with the Design I of FIG. 11 and FIG. 16 having to do with Design III of FIG. 13. The method includes providing a continuous strip 4′ of a fuse metal which is sequentially advanced the distance of a blank 4′ between distances 4‴ as indicated in dotted lines in these figures. The strip 4′ of fuse metal is initially provided throughout its length with a centrally arranged groove 24 to provide the strip with a longitudinally extending central portion of reduced thickness having a fixed thickness dimension as illustrated in FIGS. 15 and 16. The groove 24 may be initially provided in the strip 4′ by milling and scarfing with close tolerances. Where it is considered desirable to avoid contact resistance problems due to oxidation of the fuse metal at the terminal-forming blade portions 8—8 of a plug-in fuse element 4, the most efficient method of overcoming this problem is by locating the plating or the strip on all areas but those on the ungrooved side of the strip opposite the groove, so the tinning material will not extend along the fuse-forming link portion of each plug-in fuse element formed from the blank.

The advancing strip 4′ of fuse metal is first edge stamped as indicated at 68 to provide accurate width dimensions to the strip 4′ and the blanks 4″ formed therein. The strip is also provided with notches 69 in the edges thereof at the dimensions 4‴ subsequently to form edge tapers on the blade forming portions 8. Next, the interlock openings 26 are blanked in the strip. Following this, the advancing strip 4′ of fuse metal is then blanked to form the terminal blade portions 8, the current carrying extensions 14 thereof and the further extensions or tabs 18 thereof, and the fuse forming link portion 20 of fixed reduced thickness dimension. This blanking may be accomplished in one blanking operation as illustrated in FIG. 15 or in a plurality of, for example two, blanking operations as illustrated in FIG. 16. In the two-step blanking operation in FIG. 16 the strip is first blanked as indicated at 66 to form a portion of the current carrying extensions 14 and a portion of the fuse link 20. Thereafter, the strip is blanked at 64 to complete the formation of the current carrying extensions 14 and the fuse link portion 20 of reduced thickness extending between the current carrying extensions 14. During this same blanking operation, the extensions or tabs 18 are formed. In the method illustrated in FIG. 15 where a single blanking operation is utilized, the blanking at 66 and 64 occurs simultaneously. In both of these blanking operations the transverse web 10′ still remains between the terminal forming blade portions 8 of each blank. Because of the groove 24 extending throughout the length of the strip 4′ of fuse metal, the transverse web 10′ is also of reduced thickness having the fixed thickness dimension, but it has sufficient rigidity and strength to rigidify the plug-in fuse elements 4′ during the processing thereof.

As shown in FIGS. 15 and 16, the housing 6 is inserted over the end blanks 4″ to receive the current carrying extensions 14 and the further extensions or tabs 18 thereof and the fuse forming link portion 20 within the housing and with the terminal forming blade portions 8 still interconnected by the transverse web 10′ extending from the housing. The housing is then cold staked in the interlock openings 26 of the end blank 4″ as indicated in FIG. 6. Preferably, the placing of the housing 6 over the end blank 4″ and securing the housing to the end blank occurs after severing the end blank from the strip at the blank edge 4‴. In this method the severed end blank 4″ is securely held while the housing is being inserted thereover and being staked thereto. This then forms the substantially completed plug-in fuse assembly, but with the transverse web 10 still intact. The projections 52 which meet within the openings 26 as illustrated in FIG. 6 are then ultrasonically welded together to form a firm connection through the openings 26 between the sides 30*a*–32*a*. Thereafter, the transverse web 10′ is blanked at 12 to provide the spaced apart terminal forming blade portions 8 as indicated in FIG. 1. Also thereafter, the ends of the terminal forming blade portions 8 may be coined as illustrated at 9 in FIG. 1 to form tapered ends for the terminal forming blade portions 8. In this way, the complete plug-in fuse assembly as illustrated in FIG. 1 may be provided which may have desired selected fuse ratings as described above.

As expressed above, the strip 4′ of fuse metal may be plated, such as tin plated, along the portions of the strip forming the terminal forming blade portions 8—8, the current carrying extensions 14—14 thereof, and the extensions or tabs 18 thereof to provide good electrical contact between the terminal forming blade portions 8—8 and the pressure clip terminals in a mounting panel in which they are received.

Before the blanking operations illustrated in FIGS. 15 and 16 are made, the strip 4′ may be selectively printed at spaced apart intervals therealong in desired selected colors corresponding to desired selected fuse ratings of the plug-in fuse assemblies to be made. The positioning of the printing is such that when the plug-in fuse elements are made, the printing occurs at the current carrying extensions 14 of the plug-in fuse elements 4 and since the housing is transparent such color coding on the plug-in fuse element is visible through the transparent housing. This color coding may be in addition to the fuse rating printed on the top wall 38 of the housing 6.

While for purposes of illustration herein a preferred specific method of making the plug-in fuse assembly has been disclosed herein other methods may become apparent to those skilled in the art upon reference to the disclosure, and, accordingly, this invention is to be limited only by the scope of the appended claims.

We claim

1. A method of making plug-in fuse elements having different desired fuse ratings and each comprising a plug-in element including a pair of spaced confronting generally parallel terminal forming blade portions to be received by pressure clip terminals or the like, a pair of confronting current carrying extensions projecting longitudinally from the inner ends of the pair of terminal forming blade portions and a fuse-forming link portion interconnecting the current carrying extensions, said method comprising the steps of providing substantially identical blank portions of fuse metal for forming fuse elements of different fuse ratings which blank portions are initially provided within the longitudinal margins thereof with longitudinally extending portions of substantially identical reduced thickness and substantially identical width for fuse elements of different fuse ratings to be made therefrom, blanking said portions of reduced thickness of each blank portion to leave on opposite sides thereof a pair of spaced confronting general parallel terminal forming blade portions to be received by pressure clip terminals of the like and confronting current carrying extensions projecting longitudinally from the inner end portions of each pair of terminal forming blade portions, the fuse elements of different ratings being obtained by blanking said longitudinally extending portions of reduced thickness to provide fuse-forming links of substantially different locations between the confronting portions of said current carrying extensions where the heat dissipation characteristics thereof are substantially different.

2. The method of claim 1 wherein said blanking step forms in said blank portions of different ratings fuse-forming links of different configurations which include a configuration which is relatively straight and a configuration which is undulating.

3. The method of making plug-in fuse elements having different desired fuse ratings and each comprising a plug-in element including a pair of spaced confronting generally parallel terminal forming blade portions to be received by pressure clip terminals or the like, a pair of confronting current carrying extensions projecting longitudinally from the inner ends of the pair of terminal forming blade portions and a fuse-forming link portion interconnecting the current carrying extensions, said method comprising the steps of providing substantially identical blank portions of fuse metal for forming fuse elements of different fuse ratings which blank portions are initially provided within the longitudinal margins thereof with longitudinally extending portions of substantially identical reduced thickness and substantially identical width for fuse elements of different fuse ratings to be made therefrom, blanking said portions of reduced thickness of each blank portion to leave on opposite sides thereof a pair of spaced confronting general parallel terminal forming blade portions to be received by pressure clip terminals or the like and confronting current carrying extensions projecting longitudinally from the inner end portions of each pair of terminal forming blade portions, the fuse elements of different ratings being obtained by blanking said longitudinally extending portions of reduced thickness to provide fuse-forming links of substantially different configurations between the confronting portions of said current carrying extensions.

4. The method of claim 3 wherein said blanking step forms fuse-forming links in the fuse elements of different ratings which have a configuration which is relatively straight and a configuration which is undulating.

5. The method of claim 3 wherein said blanking step forms fuse-forming links in the fuse elements of different ratings which include a relatively U-shaped configuration and a repeatedly undulating configuration.

6. The method of claim 3 wherein said longitudinally extending portions of reduced thickness formed in said blank portions are continuous to extend the full length of said blank portion.

7. The method as defined in claim 3 wherein said blanking step for making fuse elements of different ratings in said identical portions of reduced thickness forms said fuse-forming link portions with substantially different width dimensions.

8. The method as defined in claim 3 wherein said blanking step for making fuse elements of different ratings forms fuse-forming link portions with substantially different lengths.

9. The method as defined in claim 3 wherein said blanking step for making fuse elements of different ratings forms fuse-forming link portions with substantially different width and length dimensions.

10. The method as defined in claim 3 wherein said blank portions of reduced thickness are continuous over the length of the blank portions and are reduced by a step including decreasing the thickness from one side only of the blank.

11. The method of claim 3 wherein said fuse-forming link portions of the fuse elements are too thin to maintain the integrity thereof, said blanking operation leaving a rigid web between each pair of terminal forming blade portions thereof, and the method includes the steps of securing between said current carrying extensions insulating means which rigidly interconnects the same, at least said pair of terminal blade portions of the blank and said rigid web being outside of the insulating means, and blanking the exposed rigid web of fuse metal interconnecting the terminal blade portions.

12. The method as defined in claim 3 including printing the blank in desired selected colors at current carrying extensions of the plug-in unit for color coding the same in accordance with the desired fuse ratings.

13. The method of making plug-in fuse assemblies having different desired fuse ratings and each comprising a plug-in element including a plate-like body of fuse metal having a pair of spaced terminal forming blade portions to be received by pressure clip terminals or the like, current carrying extension at the inner ends of said pairs of terminal forming blade portions and fuse-forming link portions of reduced thickness interconnecting the current carrying extensions, said method comprising the steps of providing strips of fuse metal for forming fuse elements of different fuse ratings which strips are initially longitudinally provided within the longitudinal margins and throughout the lengths thereof with continuous portions of reduced thickness, sequentially advancing the continuous strips of fuse metal, blanking said strip portion of reduced thickness to leave on opposite sides thereof at longitudinally spaced intervals in said strip spaced longitudinally extending interconnected pairs of terminal forming blade portions, and current carrying extensions interconnected by fuse-forming link portions of reduced thickness, the fuse elements of different ratings being obtained by forming said fuse-forming link portions of different configurations and/or locations along the confronting margins of said pairs of current carrying extensions, and severing completed plug-in elements from the end of each strip.

14. The method of making plug-in fuse assemblies having different desired fuse ratings and each comprising a plug-in element including a plate-like body having a pair of spaced terminal forming blade portions to be received by pressure clip terminals or the like, current carrying extensions at the inner ends of said terminal forming blade portions and fuse-forming link portions interconnecting the current carrying extensions, and rigid insulating means interconnecting said current carrying extensions and with the pair of terminal forming blade portions thereof extending outwardly from said insulating means, said method comprising the steps of providing strips of fuse metal for forming fuse elements of different fuse ratings which strips are initially longitudinally provided throughout their lengths with continuous central portions of substantially identical reduced thickness and substantially identical width for fuse elements of different fuse ratings to be made therefrom, sequentially advancing the strips of fuse metal, blanking said strips of fuse metal to provide at spaced intervals in said strips longitudinally interconnected blanks containing pairs of laterally spaced terminal forming blade portions formed outside of said reduced thickness portions interconnected by rigid webs formed at least in part in said reduced thickness portions, current carrying extensions at the ends of said pairs of terminal forming blade portions formed externally of said portions of reduced thickness and fuse-forming link portions formed in said portions of reduced thickness, said interconnecting fuse-forming link portions of reduced thickness for the fuse elements of different ratings being obtained by blanking said portions of reduced thickness in said strips of fuse metal which form the differently rated fuse elements so the fuse-forming link portions have substantially different locations and/or configurations, severing the end blanks from the sequentially advanced strips of fuse metal, and anchoring to the current carrying extensions of each end blank a rigid insulating means with the pair of terminal blade portions of the end blank and the rigid web outside of the insulating means, and blanking the rigid webs of each end blank.

* * * * *